US005722692A

United States Patent [19]

Abramov

[11] Patent Number: 5,722,692

[45] **Date of Patent: *Mar. 3, 1998**

[54] BOOKLET FILING DEVICE

[76] Inventor: Igor Abramov, 510 Stratford Ct. #304B, Del Mar, Calif. 92014

[ * ] Notice: The term of this patent shall not extend beyond the expiration date of Pat. No. 5,197,762.

[21] Appl. No.: 221,528

[22] Filed: Mar. 30, 1994

[51] Int. Cl.[6] ..... B42D 17/00

[52] U.S. Cl. ..... 281/43; 211/46; 312/184

[58] Field of Search ..... 281/43, 45, 51; 402/5, 8, 17, 79; 312/184; 283/117; 211/46, 113; D19/75, 78, 86, 90, 32; 40/359, 530, 390; 206/425

[56] References Cited

U.S. PATENT DOCUMENTS

| | | | |
|---|---|---|---|
| D. 268,348 | 3/1983 | Beleckis | D19/32 X |
| 3,680,969 | 8/1972 | Gorman | 281/31 X |
| 3,850,488 | 11/1974 | Elias et al. | 211/45 X |
| 3,865,445 | 2/1975 | Dean et al. . | |
| 4,181,381 | 1/1980 | St. Amand | 281/43 X |
| 4,395,058 | 7/1983 | Terrell | 281/43 X |
| 4,420,086 | 12/1983 | Bardes . | |
| 4,645,237 | 2/1987 | Squire et al. . | |
| 4,681,232 | 7/1987 | Du Corday | 281/46 X |
| 4,722,626 | 2/1988 | Abilsaard . | |
| 4,842,435 | 6/1989 | Thomas et al. | 211/45 X |
| 5,187,888 | 2/1993 | O'Brien et al. | 40/359 |
| 5,197,762 | 3/1993 | Abramov . | |

OTHER PUBLICATIONS

The 1989 Miller's Office Products Catalog, pp. 499 and 502.
The 1991 Jacobs Gardner Office Products Catalog, p. 590.

*Primary Examiner*—Willmon Fridie, Jr.

[57] ABSTRACT

A booklet filing device (200) is disclosed which comprises an elongated, essentially flat strip with two hook sections (202) on each distal end, elongated longitudinal slot (204) through which a booklet is inserted, the assembly suspended from suspension rails (312) of a hanging type filing system. Variations of the device include user-modifiable label tabs (200*c*), and user-modifiable filing bar (226) mountable in a ring binder.

19 Claims, 5 Drawing Sheets

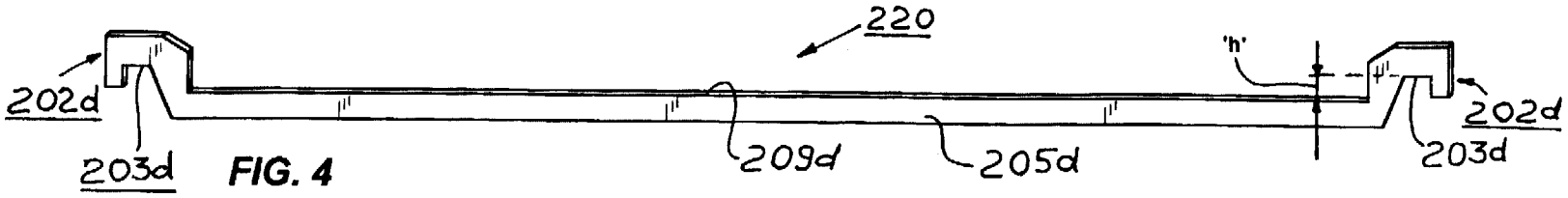
FIG. 4
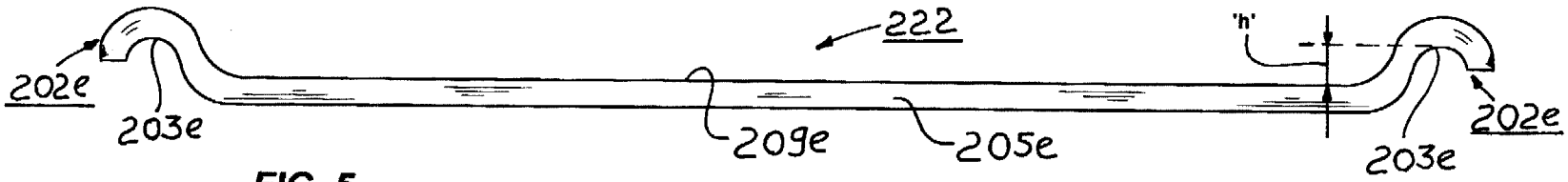
FIG. 5
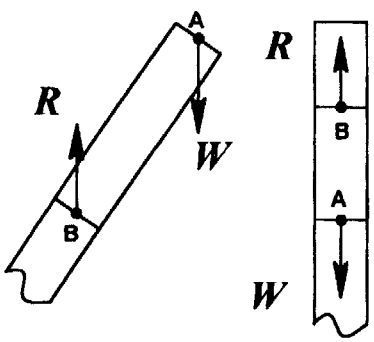
FIG. 8B
FIG. 8A
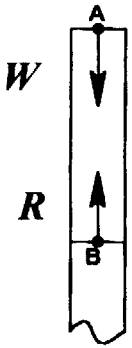
FIG. 8
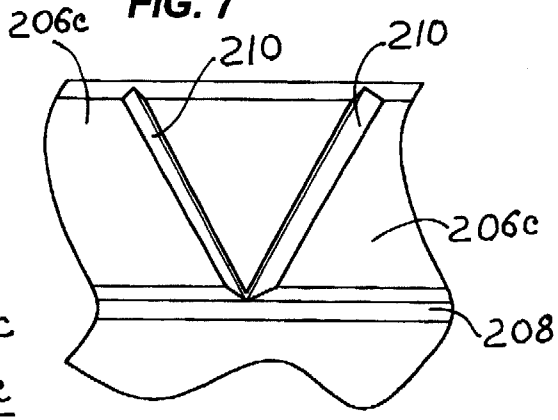
FIG. 7
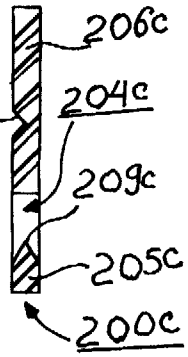
FIG. 6
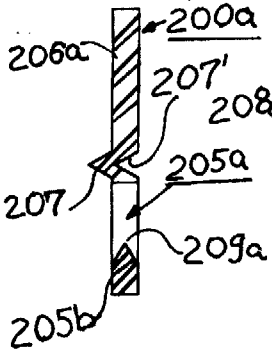
FIG. 6A

BOOKLET FILING DEVICE

This invention relates to filing of booklets, pamphlets, magazines, catalogs and other bound printed matter, and specifically to filing of such matter in suspension-type filing systems.

BACKGROUND OF INVENTION

It is often of considerable interest to file thin bound booklets, such as catalogs, magazines in a manner that is convenient, cost-effective, enables effective cataloging and efficient retrieval of such articles. Thin bound booklets are somewhat hard to file, both because they are quite pliable and will generally not stand by themselves unsupported, and also because they lack spines on which identification, such as title, number, etc. can be printed.

A booklet can be inserted in the widely used hanging-style file folder, but it will tend to curl and slide to the bottom of the folder. In addition, a label has to be attached to the folder for identification. A number of holes can be punched in a booklet in order to file it in a ring binder, but this solution is not optimal either: some booklets are hard to punch due to their thickness, the punch holes tend to deface a booklet, and there is no convenient way to easily identify a booklet once it is installed in a binder, short of installing dividers with tabs as well.

Various implements have been suggested for filing booklets directly in hanging type systems (for example, U.S. Pat. Nos. 3,865,445, 4,420,086, 4,722,626,) but they all require the use of either existing holes in booklets or deliberate making of such holes. This is deemed inadequate for the reasons stated above.

A device to file booklets in a ring binder is described in a U.S. Pat. No. 4,645,237, but, although quite simple in construction, it does not offer sufficient stability to the filed booklet by not restricting enough the latter's movement. A filed booklet is therefore free to become skewed and potentially jammed in the binder, especially when the binder is in vertical position.

SUMMARY OF THE PRESENT INVENTION

The purpose of this invention, therefore, is to provide a straightforward and cost-effective method to file thin booklets in a widely used hanging file systems and ring binders.

It is a further purpose of this invention to provide a filing device for booklets which is reusable.

It is still a further purpose of the present invention to provide a filing device that will not damage booklets should they be separated from the filing device.

It is yet another purpose of this invention to provide a simple method of identification of the filed booklets.

It is a further purpose of this invention to provide a versatile filing device which would enable direct filing of booklets not only in hanging file drawers, but in ring binders as well.

It is yet another purpose of this invention to provide a filing device for a thicker bound matter, such as large catalogs.

It is a further purpose of this invention to provide a filing device which provides orderly filing of booklets, without their skewing or tilting.

Advantageously, the present booklet filing device, hereinafter referred to as a 'filing bar' or simply a 'bar' for convenience, enables direct filing of booklets in hanging type drawers without resorting to file folders. In one of its embodiments, the bar also enables convenient, direct filing of thicker bound matter, such as catalogs, in hanging file drawers.

In addition, in one of its embodiments the bar can also be easily modified by the user, making it suitable for: (1) filing of thin booklets directly in hanging file drawers, (2) filing booklets in ring binders, or (3) filing thicker catalogs directly in hanging file drawers. Considerable savings in time and costs associated with office supplies inventory and ordering can be realized by the use of a single versatile device.

In another of its embodiment, the bar has different locations for the label tabs, similar to those on the hanging file folders. Additional embodiments contain user-modifiable label tabs.

In all of its embodiments, except the embodiment interfaceable with a ring-type binder, the bar's construction ensures stable vertical alignment of filed booklets.

Furthermore, the design of the filing bar easily lends itself to mass production and the use of inexpensive materials, such as plastic, metal, or other material sufficiently stiff in thin sections to support a booklet.

BRIEF DESCRIPTION OF THE DRAWINGS

FIGS. 4 and 5 show a simplified filing bar used primarily with thicker booklets.

FIG. 6 shows cross section taken along the line 6—6 on FIG. 3.

FIG. 6A shows cross section taken along the line 6A—6A on FIG. 1*a*.

FIG. 7 is an enlarged view of the area 7 on FIG. 3.

FIGS. 8 through 8*b* show the diagram of forces acting on the filing bar when it is deployed.

DETAILED DESCRIPTION OF THE INVENTION

Figure 1:
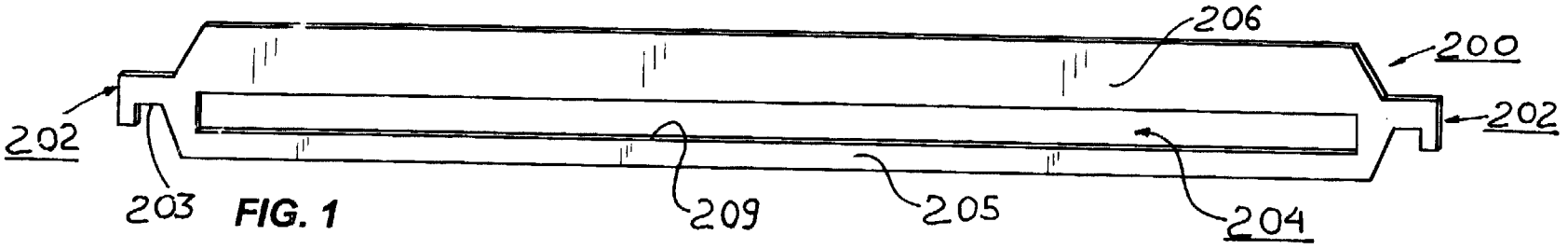
FIG. 1 shows the primary embodiment of the filing bar.

In its preferred embodiment the device is essentially a flat filing bar 200 equipped with a hooked section 202 on each end and an elongated narrow longitudinal slot 204 in the middle as shown in FIG. 1. The bar 200 is constructed from a single piece of material such as plastic, metal or stiff treated cardboard. The bar contains label tab 206 extending essentially the length of the slot 204, and which is used for attaching identification labels and also for structural support. The longitudinal slot 204 is made sufficiently wide and tall to accept common size magazines and catalogs.

Figure 3:
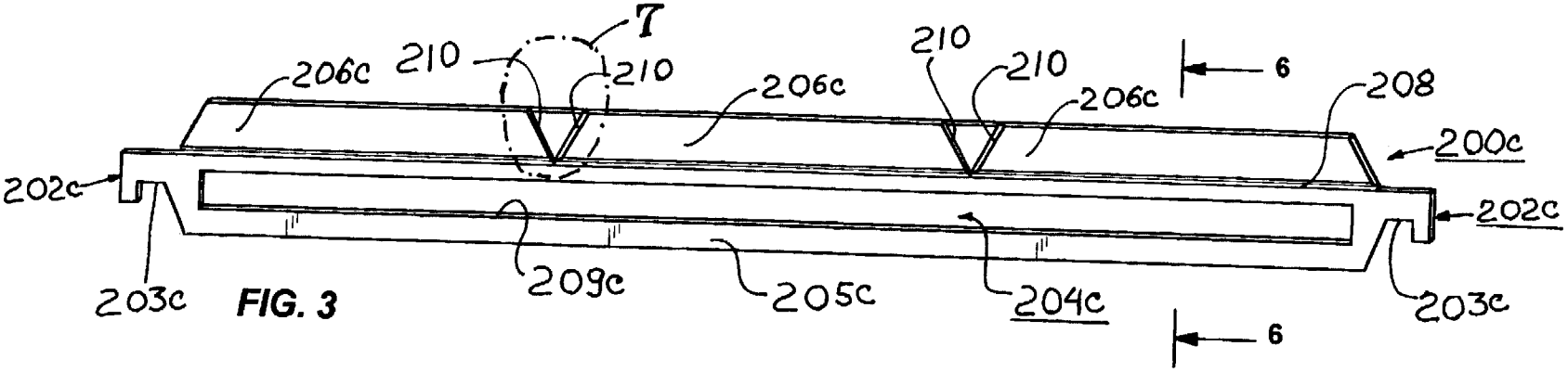
FIG. 3 shows another variation of the primary embodiment featuring severable label tabs.
Figure 3B:
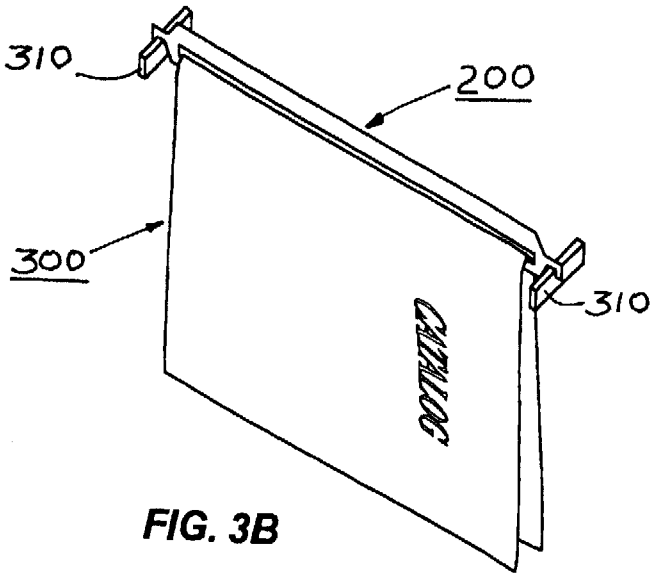
Figure 3A:
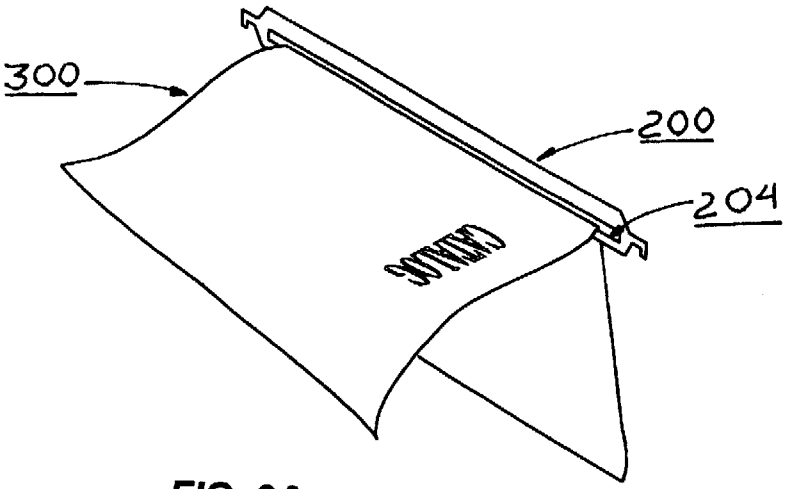

As shown on FIGS. 3A and 3B a booklet 300 is first opened at its middle and inserted into the slot 204 of the filing bar 200. This assembly is then lowered onto the rails 310 of the hanging file system. The booklet essentially straddles the lower member 205 which bears the full weight of the booklet. When in a filing position, the booklet is supported by the upper edge 209 of the lower member 205 and the weight bearing surfaces 203 on the underside of hook sections 202 engage the rails 310 of the filing system and transfer the combined weight of the bar and the booklet thereupon.

Figure 1A:
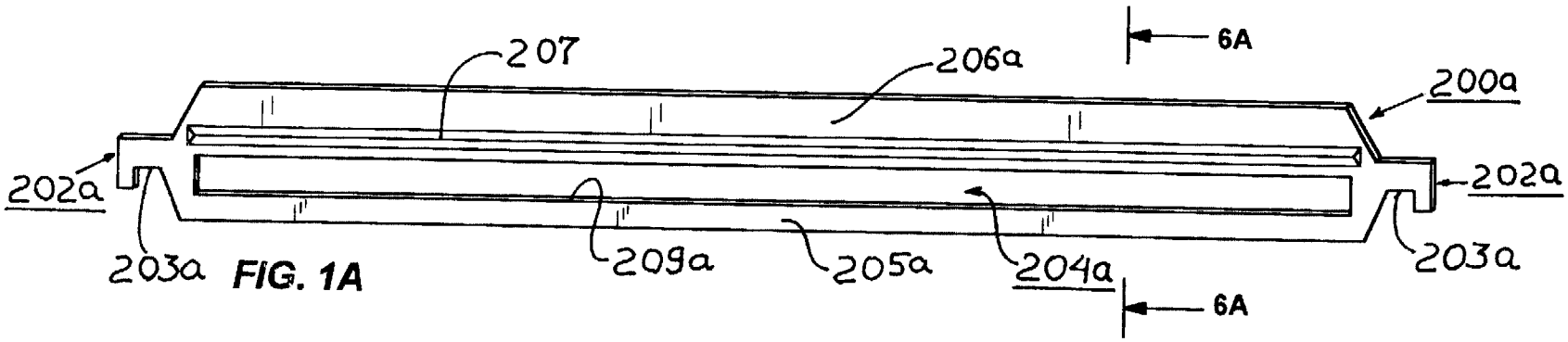
FIG. 1A shows a variation of the primary embodiment featuring the stiffening rib.

The lower member 205 when loaded by a booklet is in tension, while the label tab 206 is in compression. Thin structural sections such as the bar work very well under tension, but may be susceptible to bending under excessive compressive loads. To improve the weight bearing capacity of the device and enable it to carry a substantial weigh when required, a stiffening rib 207 is added to the label tab **206*a* in a bar modification 200*a* shown on FIG. 1A. A cross section of the bar 200*a* taken along the line 6A—6A is shown on FIG. 6A. The stiffening rib 207 is shown as triangular in cross section, but this shape is not mandatory for the function performed. The rib can have a semicircular or rectangular cross section, for example, and still achieve the intended purpose. In addition, the upper member 206*a* can contain a depression 207' on the obverse side directly opposite the stiffening rib and complementary to it in shape. This feature allows efficient stacking of the devices for packaging. In the embodiment on FIG. 1A the hook sections 202*a*, the weight bearing areas 203*a*, the longitudinal slot 204*a*, the lower member 205*a*, the label tab 206*a*, and the upper edge 209*a* are essentially identical to the respective elements 202, 203, 204, 205, 206 and 209**.

In all embodiments discussed so far and the ones to follow, the lower member 205 preferably has a triangular shape at its upper portion, culminating in the upper edge 209, as shown on FIGS. 6 and 6A. This shape permits easier draping of the booklet on the lower member 205, by not distorting abruptly the booklet's middle pages close to binding. This shape is easily produced in an injection molding process.

Figure 2:
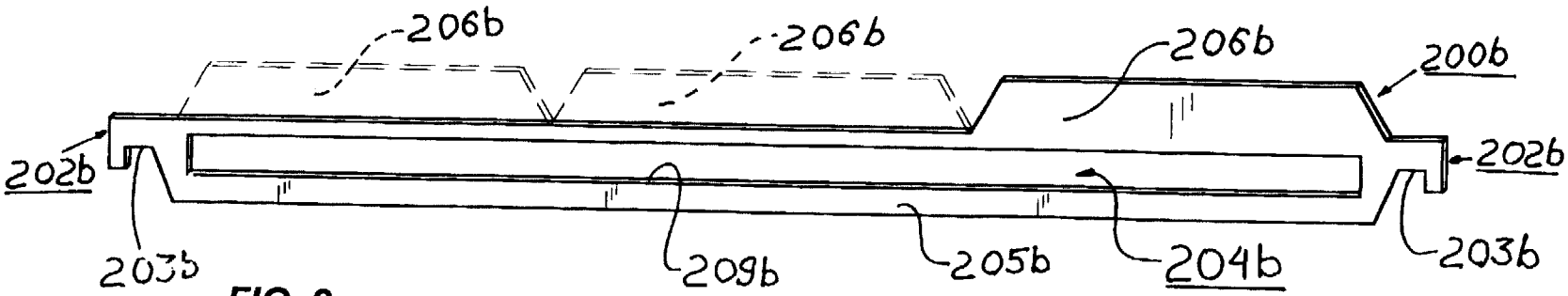
FIG. 2 shows a variation of the primary embodiment featuring separate label tabs.

In embodiments 200 and **200*a* a label or labels can be positioned anywhere along the upper members 206 and 206*a*. It may be desirable, however, to have an improved label visibility inside the file drawer by staggering labels. The embodiment 200*b* of the bar shown on FIG. 2 demonstrates how the device can be made to have staggered label tabs similar to the tabs on hanging folders. The tabs 206*b* shown as '⅓ cut' common in hanging file folders can be made in any of the three positions shown, or they can be made narrower or wider, to resemble, for instance, '⅕ cut' or '½ cut' tabs of the file folders. A set of such devices with complementary tab positions can be packaged for sale as a unit. In this embodiment the hook sections 202*b*, the weight bearing areas 203*b*, the longitudinal slot 204*b*, the lower member 205*b*, and the upper edge 209*b* are essentially identical to the respective elements 202, 203, 204, 205, and 209** of the preferred embodiment.

FIG. 3 shows yet another modification of the filing bar **200*c* in which the label tabs 206*c* are defined by a common horizontal separation V-groove 208, and a plurality of individual tab separation V-grooves 210. This construction offers a user an opportunity to modify the bar by retaining only the needed label tabs, while breaking off and discarding the rest of the tabs. It should be noted that in this, and the following examples, the separation V-grooves can be substituted by perforations without the loss of the intended function. In this embodiment the hook sections 202*c*, the weight bearing areas 203*c*, the longitudinal slot 204*c*, the lower member 205*c*, and the upper edge 209*c* are essentially identical to the respective elements 202, 203, 204, 205, and 209** of the preferred embodiment.

The label tabs generically referred to here as 206 in addition can have a suitable coating or surface treatment applied to them, so as to facilitate direct writing on them with common instruments, such as pens, pencils, markers, and the like.

Figure 9:
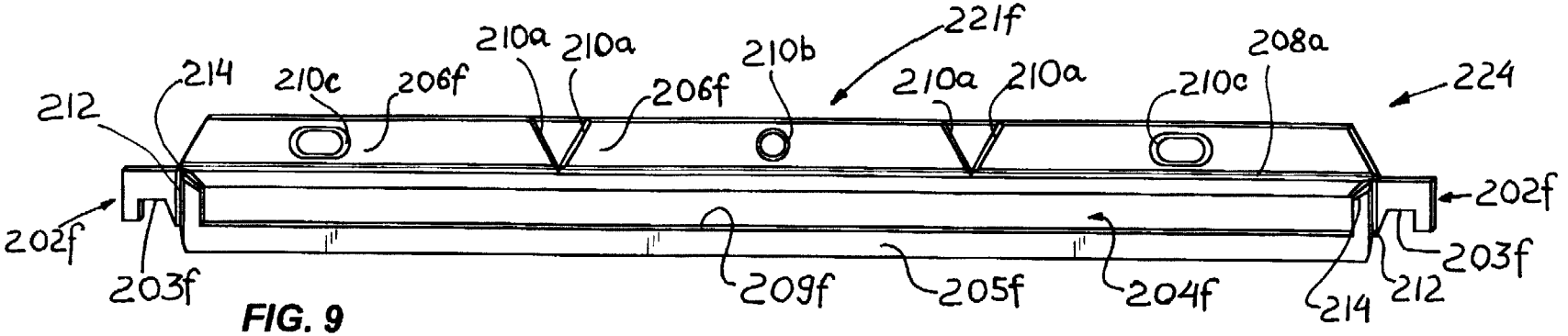
FIG. 9 depicts a versatile filing bar with severable hanging hooks, label tabs and binder mounting holes.
Figure 10:
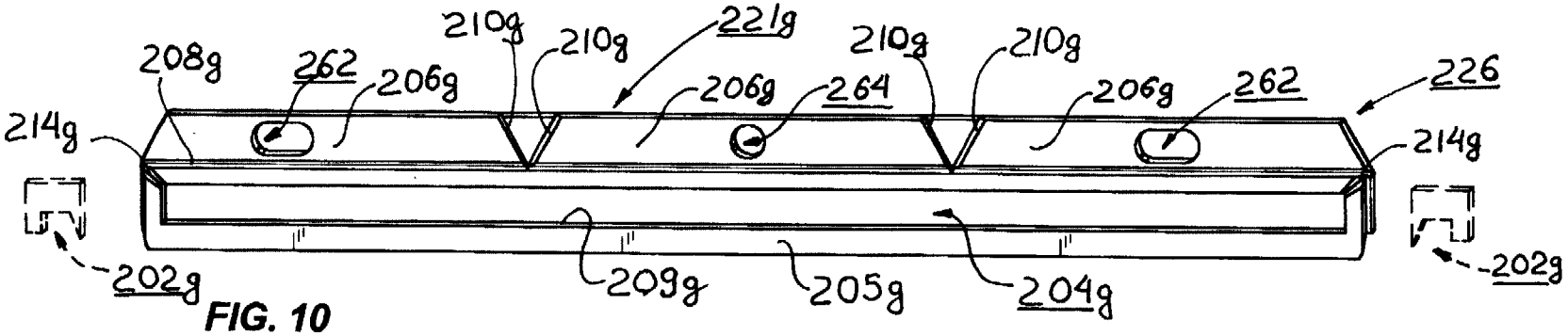
FIG. 10 shows the filing bar of FIG. 9 prepared for installation into a ring binder by severing the hanging sections and punching out pre-defined mounting holes.
Figure 11:
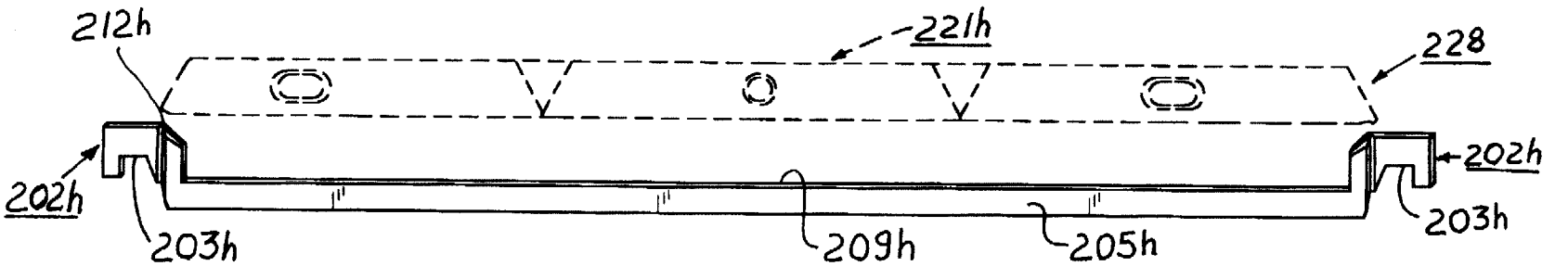
FIG. 11 shows the filing bar of FIG. 9 prepared for filing of thick booklets into a hanging file drawer by severing the upper body member of the bar.

To offer even more versatility to the device, embodiments 224, 226, and 228 shown correspondingly on FIGS. 9, 10, and 11 contain additional break-away parts. The filing bar 224 contains a plurality of separation V-grooves to allow significant modification of the device by the user. In its starting form denoted 224, the bar can be used for filing as is, and in fact, it is very similar to the embodiment **200*c* on FIG. 3. The user can further modify it by breaking off the unneeded label tabs 206*f* defined in the upper member 221*f* by the separation V-grooves 208*a* and 210*a*. Conversely, a user may elect to remove the whole upper section 221*h* in FIG. 11 along the separation V-grooves denoted 214 in FIG. 9 and 214*g* in FIG. 10 to obtain device 228 on FIG. 11. In these embodiments the hook sections 202*f*, 202*g*, 202*h*, the weight bearing areas 203*f*, 203*h*, the longitudinal slot 204*f*, 204*g*, the lower member 205*f*, 205*g*, 205*f*, and the upper edge 209*f*, 209*g*, 209*h* are essentially identical to the respective elements 202, 203, 204, 205, and 209** of the preferred embodiment.

Figure 13:
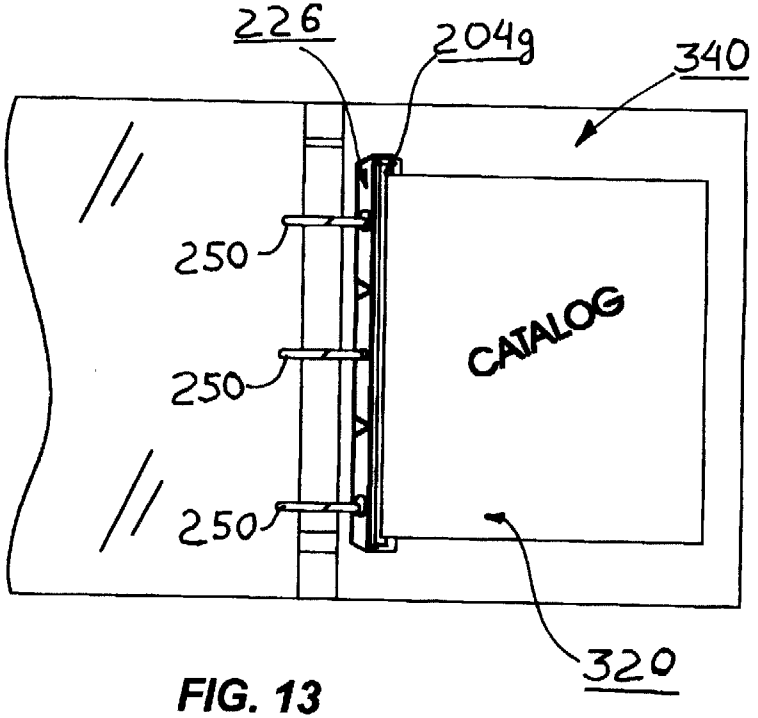
FIG. 13 is a perspective view of a booklet used with the modified filing bar installed into a ring binder.

A user can also modify the bar 224 by punching out rounded sections in the upper member **221*g* defined by the separation V-grooves 210*b* and 210*c* to expose the through holes 262 and 264 in FIG. 10. Thusly modified bar can then interface with the locking rings of a ring-binder and be inserted therein, if the latter is sufficiently large to accept the whole filing bar. If this is not the case, the hook sections 202*f* in FIG. 9 can be broken off at separation V-grooves 212. The severed hook sections denoted 202*g* in FIG. 10 are included for illustration. Although there are three through holes shown in this embodiment, it should be understood that more holes and inter-hole spacing can be defined, to fit the number, size, and separation of locking rings of popular binders. FIG. 13 illustrates a booklet 320 inserted through the slot 204*g* of the modified bar 226, the whole assembly being held in a binder 330 by locking rings 250**.

The important feature of all of the filing bar embodiments of this patent application is the vertical separation of the upper edges, here generically referred to as 209, of the lower members here generically referred to as 205 from the weight bearing surfaces here generically referred to as 203 of the device. The vertical separation specifically shown as 'h' in FIGS. 4 and 5 is important for proper filing of the booklets with this type of device. FIGS. 8, 8A, and 8B illustrate the forces acting on the filing bar under different load positioning.

On FIGS. 8 and 8A the upper edge 205 is made, for illustration purposes only, higher than the weight bearing areas 203. On FIG. 8 the weight of a booklet denoted W is applied at point A which approximates the upper edge 205. The supporting reaction force R transmitted from the rails of a filing drawer is applied at point B which approximates weight bearing areas 203 (i.e. the contact with the filing rails). As shown in FIGS. 8 and 8A, although the force W is equal in magnitude to the force R, if point A is above point B, the position is unstable, and a rotating moment about the weight bearing surfaces will be created at the slightest deviation from the vertical, which will tend to overturn the bar. This will lead to random tilting of filed booklets and impair effectiveness of their filing. If, however, point A is made to be above the point B by positioning the weight bearing areas above the booklet support as shown on FIG. 8B, a stable arrangement results, with the booklet 'cradled' on the bar. Any disturbance away from vertical will generate a rotating moment which will return the assembly back to vertical.

The booklet support edges 209 in all embodiments of the bar are always located below weight bearing surfaces 203. This feature ensures that the filed booklets are always positioned vertically and their tilting is prevented.

FIGS. 4 and 5 show simplified filing bars made (1) from a narrow strip, denoted 220 or (2) from round bar stock, denoted 222. In addition to the simplicity of design and associated ease of manufacture and low cost, these embodiments enable filing of thicker brochures with many pages, such as bound catalogs, which may not be able to pass through the slot 204 in the body of the bar. As with the previous embodiments, a booklet straddles the lower members **205*d* and 205*e*** respectively, and is filed on the rails of a hanging file drawer.

Figure 12:
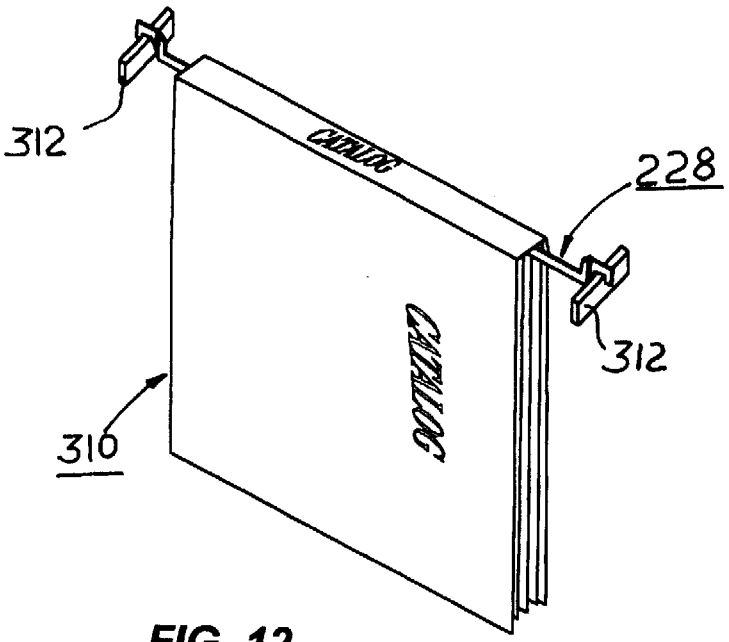
FIG. 12 is a perspective view of a thicker booklet filed with the modified filing bar onto suspension rails of a file drawer.

A similar structure denoted 228 on FIG. 11 can be achieved by modification of the bar 224. This particular structure is shown to file a thick catalog 310 on suspension rails 312 in FIG. 12. The need for labeling tabs in these devices is obviated by the very fact that the same thick booklets do indeed contain wide spines with all the pertinent information about the booklet already included, as also depicted in FIG. 12. When suspended from the rails, the bar/booklet assembly is very stable due to the already mentioned vertical displacement 'h' of the weight bearing areas **203*d*, 203*e*, and 203*h* with respect to the upper edges 209*d*, 209*e*, and 209*h*** in their corresponding embodiments. It is pointed out that even thin bars of this shape made out of plastic have shown significant weight bearing capacity by supporting catalogs of up to 800 pages with no failure. The reason for this is the fact that these devices work essentially under a pure tension stress.

It should be apparent to the reader that many variations of the present invention are possible without departure from the scope of the present invention. For instance, depending on a particular manufacturing processes the particular construction and selected materials may differ from those described above. For example the bar can be stamped out of plastic or metal. In case of metal stamping fabrication, various stiffening corrugations and notches are possible. The devices can also be manufactured via thermoplastic injection molding which would offer a number of options ranging from molded-in insignia, alignment features for label placement, instructions on usage, to decorative surface patterns. Also, finger grips can be added to the top part of the bar for ease of placement and removal from the file drawer. Different colors for potential color-coding of filed booklets are also possible, as well as other decorative elements.

Thus, the scope of this invention should be determined by the appended claims and their legal equivalents, rather than by the examples given.

I claim:

1. In a rail-based suspension filing system, a booklet filing device comprising: a single piece, essentially flat elongated strip having suspension means on each distal end, said suspension means interfaceable with suspension rails, said device further having a longitudinal aperture through which booklets are inserted, said longitudinal aperture made sufficiently wide and tall to permit insertion of an open booklet, said longitudinal aperture further defining lower body member and upper body member, said lower body member used to support booklet, whereby a booklet essentially straddles and is supported by said lower body member, said device further having front surface and back surface.

2. The device of claim 1, wherein the upper body member contains insignia bearing area, said insignia bearing area further made sufficiently wide and tall to accommodate filing insignia.

3. The device of claim 2, wherein the surface of the insignia bearing surface is capable of accepting marking by common marking methods.

4. The device of claim 1, wherein the upper body member comprises separation aiding means, said separation aiding means defining severable tabs in the upper body member.

5. The device of claim 4, wherein the severable tabs further comprise insignia bearing areas, said insignia bearing areas further made sufficiently wide and tall to accommodate filing insignia.

6. The device of claim 5, wherein the surface of the insignia bearing areas is made to be capable of accepting marking by common marking methods.

7. The device of claim 4, wherein the separation aiding means comprise grooves.

8. The device of claim 4, wherein the separation aiding means comprise perforations.

9. The device of claim 1, wherein the upper body member contains longitudinal stiffening member.

10. The device of claim 9, wherein the upper body member contains longitudinal depression on the side opposite said longitudinal stiffening member, said longitudinal depression aligned opposite said stiffening member, said longitudinal depression made sufficiently large to accommodate said stiffening member when one said device is placed on top of another said device.

11. A booklet filing device comprising a single piece, essentially flat elongated strip having a) body member, and b) suspension means on each distal end, said suspension means interfaceable with suspension rails of filing system, said device further having a longitudinal aperture through which booklets are inserted, said longitudinal aperture made sufficiently wide and tall to permit insertion of a booklet, said longitudinal aperture further defining lower body member and upper body member, said lower body member used to support booklet, said upper body member containing insignia bearing area, said insignia bearing area further made sufficiently wide and tall to accommodate filing insignia, said device further comprising separation aiding means, said separation aiding means defining severable sections in said device.

12. The device of claim 11 wherein the separation aiding means further define severable tabs in the upper body member.

13. The device of claim 11 wherein the suspension means are severable.

14. The device of claim 11 wherein the upper body member is severable.

15. The device of claim 11 wherein the suspension means and the upper body member are severable.

16. The device of claim 11, wherein the surface of the insignia bearing area is capable of accepting marking by common marking methods.

17. The device of claim 11, wherein the separation aiding means comprise grooves.

18. The device of claim 11, wherein the separation aiding means comprise perforations.

19. The device of claim 11, wherein said severable sections upon their removal define openings in said upper body member, said openings interfaceable with mounting rings of ring-type binders.

* * * * *